United States Patent [19]

Fraser

[11] 4,142,303

[45] Mar. 6, 1979

[54] FREEZE DRYING STOPPERING APPARATUS

[75] Inventor: Douglas S. Fraser, New Platz, N.Y.

[73] Assignee: FTS, Systems, Inc., Stone Ridge, N.Y.

[21] Appl. No.: 832,786

[22] Filed: Sep. 12, 1977

[51] Int. Cl.[2] ..... F26B 13/30

[52] U.S. Cl. ..... 34/92; 53/106

[58] Field of Search ..... 53/102, 106; 34/92

[56] References Cited

U.S. PATENT DOCUMENTS

| | | | |
|---|---|---|---|
| 2,013,548 | 9/1935 | Barnby | 53/106 |
| 3,022,619 | 2/1962 | Strong et al. | 53/106 |
| 3,448,556 | 6/1969 | Taggart | 34/92 |
| 3,451,189 | 6/1969 | Taggart | 34/92 |
| 3,537,233 | 11/1970 | Costello et al. | 34/92 |
| 3,795,986 | 3/1974 | Sutherland et al. | 34/92 |

*Primary Examiner*—John J. Camby

*Attorney, Agent, or Firm*—Robert E. Wagner; Thomas L. Kautz

[57] ABSTRACT

An improved mechanical stoppering apparatus is provided by the present invention for use with a chamber freeze dryer in which at least two shelves supporting a plurality of receptacles containing material to be freeze dried are adjustably suspended from a fixed plate one above the other for substantially isolating the shelves from the walls of the vacuum chamber of the freeze dryer to provide an even rate of sublimation along the entire surface area of the shelves. A drive means is provided for raising the lower shelf individually until the receptacles it supports contact the bottom of the upper shelf, whereupon both shelves move upwardly in tandem toward the fixed plate, the receptacles on the upper shelf being stoppered against the fixed plate and the receptacles on the lower shelf being stoppered against the bottom of the upper plate.

10 Claims, 5 Drawing Figures

FIG. 1
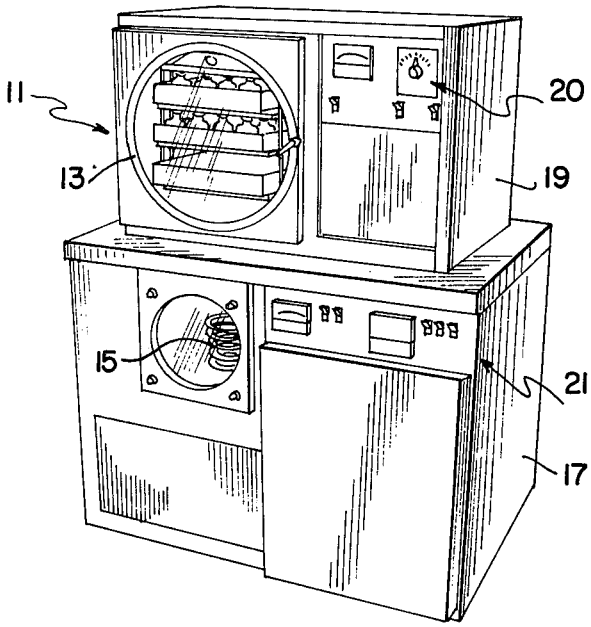
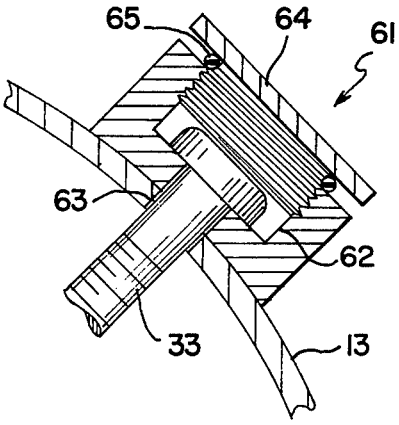
FIG. 3
FIG. 2
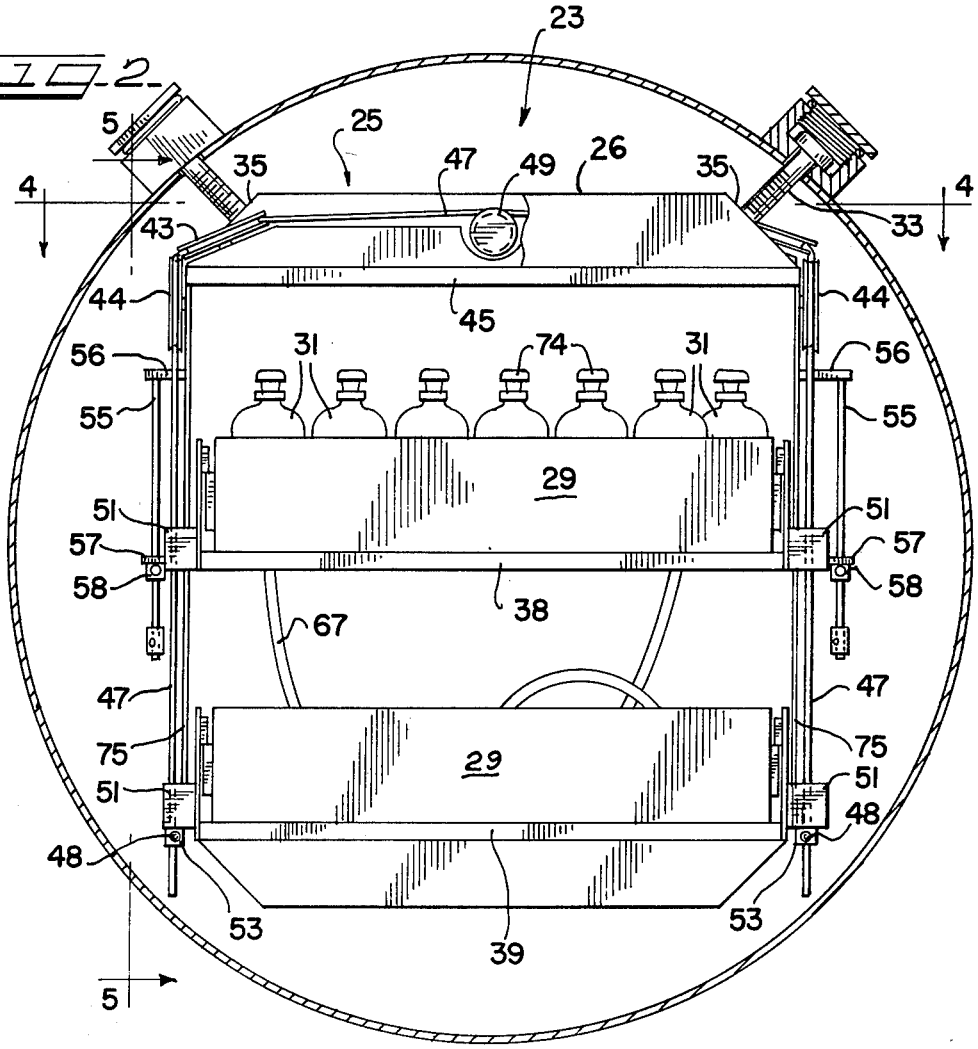

FREEZE DRYING STOPPERING APPARATUS

BACKGROUND OF THE INVENTION

This invention relates to a freeze drying apparatus having an improved automatic stoppering device and, more particularly, to a completely mechanical means for stoppering receptacles containing freeze dried materials in a closed chamber.

The well-known technique of freeze drying has provided an efficient means of preserving a wide variety of products for human and animal medicinal use. Freeze drying is similar to ordinary vacuum distillation except that the material to be dried must be solidly frozen before it is subjected to a high vacuum and controlled heat input. Under these conditions, the water content of the material is selectively removed by sublimation, going directly to the vapor state and bypassing the liquid phase. The residue is a dry powder devoid of water.

The basic components of most freeze drying systems include a vacuum chamber containing the material to be freeze dried, a condenser to trap sublimated water vapor, and a vacuum pump to provide a vacuum within the chamber. Additionally, a means of transferring heat of sublimation to the freeze drying material is required to drive the water vapor from the material to the condenser. The above components are normally assembled in combination and sold as units called freeze dryers or sublimators.

Frozen material to be dried may be placed in bulk in the vacuum chamber, but, in many applications a plurality of receptacles each containing small samples of frozen material are introduced into the chamber for drying. Use of receptacles permits the drying of large numbers of different samples at one time and eliminates the problem of contamination resulting from intermingling of samples.

It has been found that contamination may also occur if samples are exposed to the ambient air once the drying process is completed. Accordingly, a means to seal receptacles prior to their removal from the vacuum chamber into the ambient air was developed, which generally consists of a split stopper and a stoppering device. As is well known, split stoppers are formed with a slitted portion along the stem which is partially inserted into the neck of the receptacles, leaving a portion of the slit exposed through which vapors can escape during the drying process. Upon completion of the drying process, a stoppering device is used to force the split stoppers completely into the neck of the receptacles, closing off the slitted portion of the stopper and sealing the receptacles airtight.

One of the earlier stoppering devices, disclosed in U.S. Pat. No. 3,022,619 (strong et al.) consisted of a mechanical means of stoppering the receptacles upon completion of the sublimation process, which was bulky and complex in operation, making it prone to unexpected breakdowns. No built-in safety features were provided, and the stoppering process could not be reversed once initiated. Additionally, the device was not easily removable from the chamber so that bulk drying and stoppering of smaller samples could not take place within the chamber at the same time, as is often desirable.

An improved means of stoppering, disclosed in U.s. Pat. No. 3,795,986 (Sutherland et al.), was developed which simplified the mechanism of the above-named Strong et al. U.S. Pat. No. 3,022,619, but created certain disadvantages of its own. The Sutherland et al. patent discloses a bellows-type stoppering means, which employs a rubber bellows disposed between upper and lower plates. The plates are normally urged closed by spring means, but when the bellows are filled with compressed air, they expand, overcoming the force of the spring means to move the upper and lower plates apart. The expansion of the bellows continues until the lower plate contacts the stoppers of a group of receptacles disposed on a shelf positioned directly beneath the lower plate, which seals the receptacles airtight.

A problem associated with the bellows-type stoppering means, however, is the inherent limitations of the rubber material forming the bellows. The extreme pressure and temperature conditions within the vacuum chamber cause the rubber to crack and wear relatively quickly, requiring frequent replacement. In addition, rubber is a material having a certain degree of porosity. During the sublimation process, the vapors released from the materials undergoing drying may be absorbed by the bellows as they travel through the vacuum chamber to the condenser. These vapors may be released into the vacuum chamber by the bellows during subsequent drying operations, causing contamination of other samples.

Another form of mechanical stoppering device is described in U.S. Pat. No. 3,448,556 (Taggart) and illustrates a hydraulically-actuated platen which forces the bottom shelf upwardly to engage the shelf above it to stopper the bottles on the bottom shelf. The presence of a piston rod with oil and other contaminants on it in a vacuum chamber is obviously intolerable. Sealing the piston chamber from the vacuum chamber also presents a problem since one is under pressure and the other is under vacuum. To this inventor's knowledge, this unit never reached the commercial market, and the above deficiencies as well as others would hinder, if not prevent, commercial exploitation.

The rate of sublimation achieved by the devices disclosed in the Strong et al. patent and in the bellows-type stoppering device of Sutherland et al. is not uniform over the surface area of the shelf upon which the receptacles or bulk material is placed for drying. As mentioned above, the sublimation process requires that the freeze drying material be solidly frozen and then subjected to a high vacuum and controlled heat input. As discussed in detail below, in many freeze drying units, the heat of sublimation is provided by directing a heat transfer fluid through hollow shelves upon which the materials to be dried are placed. The refrigeration within the vacuum chamber is normally provided by cooling coils disposed about the outer surface of the chamber. The Sutherland et al. and Strong et al. patents mentioned above disclose apparatus which contact the chamber walls with a thermally conductive metal structure, upon which the shelves are mounted to support the material to be dried. The heat of sublimation introduced by the heat transfer fluid is not uniformly distributed over the surface area of the shelves since the contact of the stoppering apparatus with the chamber walls creates a transfer of thermal energy therebetween. The outer portions of the shelves are thus slightly cooler than the center, which prolongs the time required to dry samples placed at the outer edges of the shelves.

SUMMARY OF THE INVENTION

Accordingly, an improved mechanical stoppering means adapted for use with a chamber freeze dryer is provided by the present invention, having a relatively simplified and durable structure which is easily removable from the vacuum chamber of the freeze dryer for cleaning or repair. Generally, the present invention comprises at least two shelves suspended one above the other from a fixed plate, which is mounted to the vacuum chamber of a freeze dryer such that transfer of thermal energy therebetween is minimized, as discussed below. A drive means is provided for raising and lowering the shelves, which support a plurality of receptacles containing materials to be dried. As discussed in detail below, the lower shelf is moved upwardly individually by the drive means, until the receptacles it supports contact the bottom of the upper shelf. Subsequently, both shelves continue upwardly in tandem with the lower shelf completely supporting the upper shelf. Stoppering of the receptacles on both shelves occurs when contact is made with the plate by the receptacles on the upper shelf. The shelves are in effect squeezed together as the receptacles on the lower shelf are stoppered against the bottom of the upper shelf, and the receptacles on the upper shelf are stoppered against the plate. Once the stoppering operation is completed, the drive means is reversed to lower the shelves for removal of the receptacles.

In view of the deficiences of prior art automatic stoppering means, it is an object of this invention to provide a stoppering means for use in a freeze dryer.

It is a further object of this invention to provide a stoppering means, the structure of which is mounted within the vacuum chamber of the freeze dryer in a manner which minimizes transfer of thermal energy therebetween.

It is a still further object of the subject invention to provide a stoppering means consisting of at least two shelves suspended within the chamber one on top of the other, and supporting a plurality of receptacles containing freeze drying materials to be dried.

It is a still further object of the subject invention to provide a mechanical stoppering apparatus in a freeze dryer having a drive means for raising and lowering of the shelves for stoppering.

It is a still further object of the subject invention to provide a mechanical stoppering apparatus having means for adjusting the shelves upwardly and downwardly in relation to one another to accommodate receptacles of varying sizes.

It is still another object of this invention to provide a mechanical stoppering apparatus having a structure which allows for improved heat transfer, providing a uniform rate of sublimation along the surface area of each of the shelves.

Objects of this invention in addition to the foregoing will become apparent from the following description taken in conjunction with the drawings illustrating preferred embodiments wherein:

DESCRIPTION OF THE DRAWINGS

FIG. 1 is an over-all perspective view of a freeze drying apparatus or sublimator, showing the condenser means, vacuum chamber and the mechanical stoppering apparatus of the present invention;

FIG. 2 is a cross-sectional front view of the vacuum chamber of the freeze drying apparatus, showing the structure of the present invention, the means of mounting the structure of the present invention to the vacuum chamber walls, and the drive means of the present invention for raising and lowering the shelves;

FIG. 3 is an enlarged cross-sectional view of the means of mounting the top plate of the present invention to the vacuum chamber wall;

DETAILED DESCRIPTION OF THE INVENTION

Figure 4:
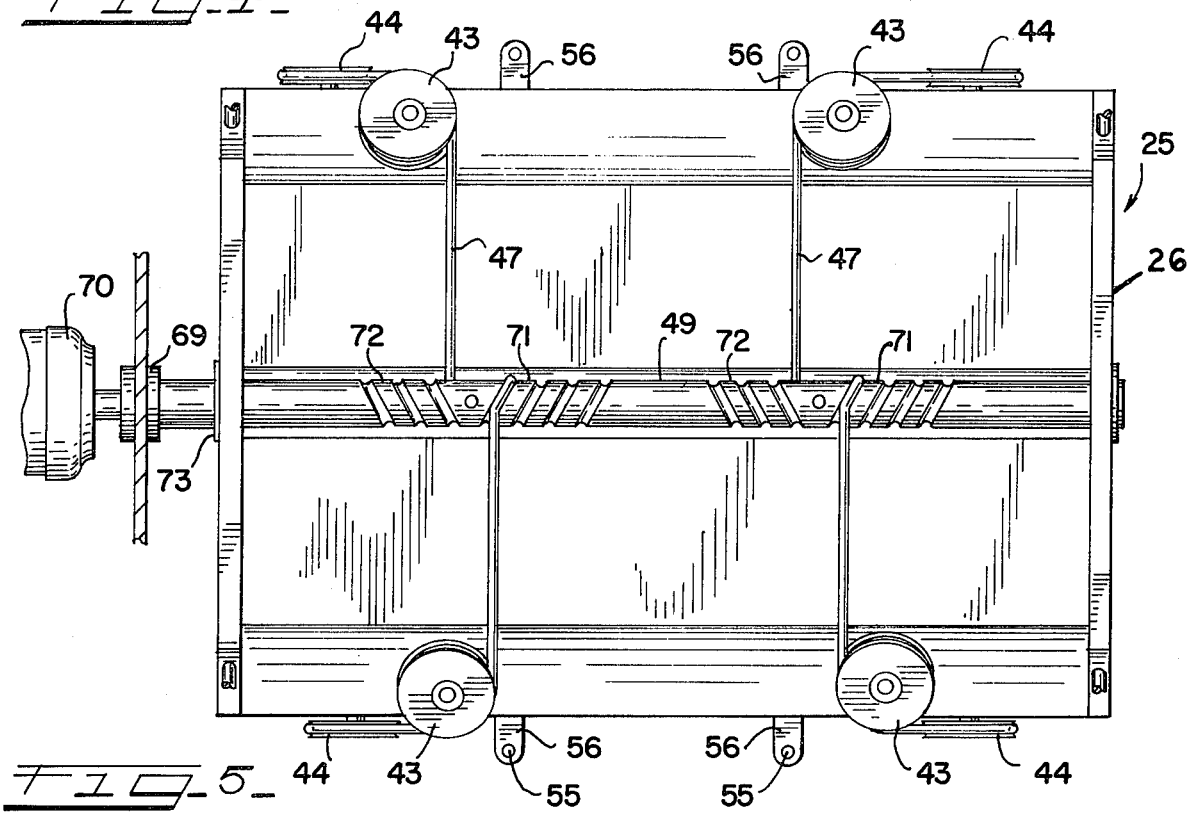
FIG. 4 is a top cross-sectional view taken along the line 4—4 of FIG. 2, showing the pulley arrangement of the present invention and the connection of the pulley lines to the threaded drive rod; and, FIG. 5 is a partial cross-sectional view taken along the line 5—5 of FIG. 2, showing a side view of the pulley arrangement, the cable shelves and guide rods, and also the connection of the pulley cable and guide rods to the shelves.

Referring now to FIG. 1, a conventional chamber freeze dryer is indicated generally by reference 11. The dryer 11 includes a vacuum chamber 13, a condenser 15 and a commercially available two-stage oil sealed, high vacuum pump (not shown) which may be contained in the lower cabinet 17. The upper cabinet 19 may include a control panel 20 which houses the instruments to monitor and control the temperature within the vacuum chamber 13. The control panel 21 mounted in lower cabinet 17 houses the controls and instrumentation to monitor and control the vacuum applied to the vacuum chamber 13 during the sublimating process.

Referring now to FIG. 2, the structure of the automatic stoppering apparatus of the present invention is labeled by reference number 23. Generally, the stoppering apparatus 23 consists of a substantially rectangular top plate 25, formed with front and rear flange sections 26, the front flange section being shown in FIG. 2, which is mounted to the upper portion of chamber 13 as described below. Upper and lower shelves 38 and 39 are suspended from top plate 25, one above the other, by mounting means, discussed in detail below. Trays 29, supporting a plurality of receptacles 31 containing material to be dried, are removably mounted on shelves 38 and 39 where they are maintained in a fixed position during the stoppering operation. The trays 29 and shelves 38 and 39 may be provided with a taper lock means to maintain the trays 29 in position on the shelves 38 and 39 during the stoppering operation. Such taper lock means may be of the type disclosed in my co-pending application Ser. No. 747,939, Filed Dec. 6, 1976, now U.S. Pat. No. 4,109,396. The stoppering apparatus is also provided with drive means which elevates the shelves 38 and 39 to accomplish the stoppering operation, and lowers the shelves 38 and 39 to their original position for removal of the receptacles 31 after stoppering is completed.

As mentioned above, a problem with certain prior art stoppering devices is that a portion of the structure of the apparatus is attached directly to the walls of the vacuum chamber, forming a thermally conductive path allowing transfer of thermal energy from the shelves of the stoppering apparatus directly to the chamber walls. This results in the unequal or uneven application of heat along the surface area of the shelves, which prolongs the time required to sublimate freeze drying materials placed on the outer portion of the shelves. In contrast, the stoppering apparatus 23 of the present invention is substantially isolated from the chamber 13 by a novel suspension system, which minimizes contact with the chamber walls, providing a corresponding reduction in heat loss.

Referring now to FIG. 2, the flange section 26 of top plate 25 is formed with an angled portion 35 at each end. The plate 25 is mounted at its corners to the upper portion of chamber 13 by four bolts 33, the front two of which are shown in FIG. 2. Aligning holes are tapped in the chamber 13 and the angled portion 35 of flange 26 to receive the bolts 33. The holes in the angled portion 35 of flange 26 are correspondingly threaded with the bolts 33 for adjustment of the plate 25 should it be jostled from the horizontal position during shipment or transfer of the apparatus 23.

As shown in FIG. 3, the bolts 33 are mounted to the chamber walls in a manner which greatly reduces the transfer of thermal energy therebetween, resulting in substantially uniform heating of the product during sublimation. A shelf mounting button 61 formed of plastic or any similarly poor heat conductive material is radially mounted to the outer surface of chamber 13 in alignment with the four holes bored in chamber 13 through which the bolts 33 downwardly extend. The shelf mounting button 61 is formed with a first bore 62 corresponding to the head of bolts 33 and a second bore 63 corresponding to the diameter of bolts 33. The first bore 62 is correspondingly threaded with a cap 64 which is inserted into button 61, and makes contact with bolts 33 to hold them securely in place. An O-ring seal 65 is provided at the point of contact between the cap 64 and button 61 for limiting loss of vacuum within chamber 13. The button 61 prevents direct contact between the bolts 33 and chamber 13 to insulate the bolts 33 from the refrigerated chamber walls.

The upper and lower shelves 38 and 39 are suspended within chamber 13 from the top plate 25 and make no contact with the chamber walls. Heat of sublimation is provided by a heat transfer fluid which flows through coils 67 into a hollow portion of shelves 38 and 39 (not shown), and is relatively constant over the entire surface area of the shelves 38 and 39 to assure even sublimation of freeze drying materials placed thereon. The shelf construction may be of the type disclosed and described in my co-pending application Ser. No. 747,939, now U.S. Pat. No. 4,109,396 mentioned above.

The lower shelf 39 is suspended from the top plate 25 by a pulley system which forms part of the drive means of the present invention discussed in detail below. At each corner of top plate 25 a first pulley 43 is mounted on the angled portion 35 of flange 26 and a second pulley 44 is mounted in a vertical position to the horizontal or shelf portion 45 of top plate 25. Guide blocks 51, formed with a central bore, are fixedly attached to upper and lower shelves 38 and 39. Pulley cables 47, attached at one end to a drive rod or shaft 49, discussed below, are threaded through pulleys 43 and 44 and extend downwardly through the bore in guide blocks 51 of the upper and lower shelves 38 and 39. The lower shelf 39 rests on an adjustable collar 53, which may be fixed at various points along the cables 47 beneath the guide block 51 on lower shelf 39. The adjustable collar 53 is a sleeve formed with a central bore corresponding to the diameter of cables 47, and a second threaded bore perpendicular to the central bore through which a set screw 48 is threaded to engage and clamp the collar 53 to the cable 47. The set screw 48 may be loosened and the collars 53 moved up and down along the cables 47 beneath the guide block 51 of lower shelf 39 for convenient adjustment of the height between the upper and lower shelves 38 and 39 to accommodate receptacles 31 of varying sizes.

The upper shelf 38 is suspended within chamber 13 by four guide rods 55, two of which are shown in FIG. 2. Side panels 75 are provided, as discussed in more detail below, which are mounted to top plate 25 and extend downwardly to the lower shelf 39. Rod ends 56 are welded to the side panels 75, adjacent the corners of top plate 25, and one end of guide rods 55 are mounted thereto. The guide rods 55 extend downwardly from the rod ends 56 through a flange 57 formed with a bore corresponding to the diameter of rods 55, which flanges 57 are mounted to the guide blocks 51 of upper shelf 38. An adjustable collar 58, similar in construction and function to collar 53 described above, is mounted on the rod 55 beneath flange 57 to support the upper shelf 38. The position of collar 58 may be varied and adjusted along guide rods 55 in accordance with the position of lower shelf 39 to accommodate different sizes of receptacles 31 on the upper shelf 38.

Figure 5:
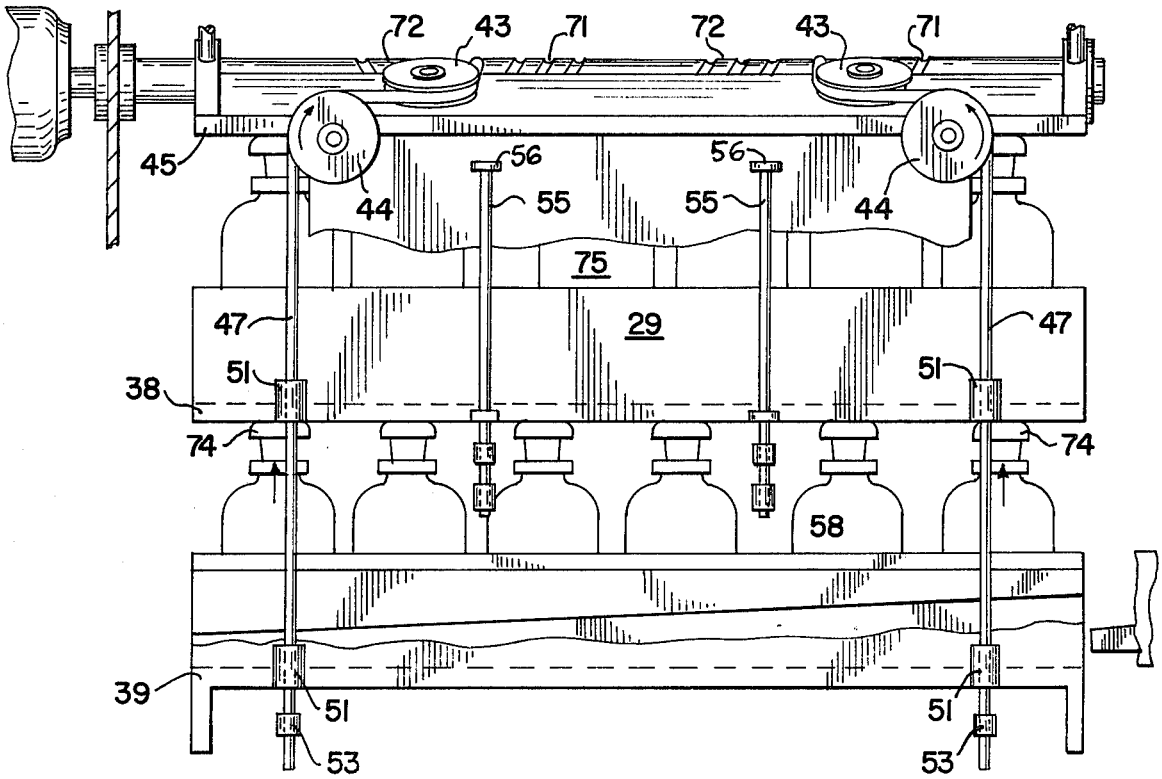

Referring now to FIGS. 4 and 5, the mechanical drive for stoppering of the receptacles 31 on both shelves 38 and 39 is shown. A drive rod or shaft 49 is rotatably mounted in the chamber 13, having one end carried on the front flange 26 of top plate 25 and the other end extending through the chamber wall for direct coupling to the output shaft 69 of a DC drive motor 70. An O-ring seal 73 is provided to seal rod 49 at the chamber wall while permitting rotation of rod 49 with output shaft 69.

As shown in FIG. 4, cables 47 are attached to rod 49 and then threaded through first and second pulleys 43 and 44, as discussed above. The rod 49 is formed with right and left-hand threads 71 and 72, which have a somewhat exaggerated pitch in the drawing for ease of illustration. As the drive motor 70 rotates rod 49, the cables 47 are wrapped around or unwrapped from rod 49 along threads 71 and 72, causing the lower shelf 39 to travel upwardly or downwardly according to the direction of rotation. As is readily apparent, the pulley system of the present invention translates the rotational movement of the drive rod 49 to a vertical travel of the lower shelf 39 within vacuum chamber 13. The first pulley 43 is mounted at a position on the angled portion 35 of flange 26 to receive a cable 47 from drive rod 49, which is threaded therethrough and extends downwardly along second pulley 44 mounted vertically to the plate 25. This unique orientation of pulleys 43 and 44 provides for an approximately 90° change of direction in cables 47 over the relatively short distance from the rod 49 to the edge of plate 25 where the pulleys 43 and 44 are mounted. The pulley system herein is a dependable means for raising and lowering the shelves 38 and 39, which eliminates the contamination of chamber 13 which may occur using hydraulically-actuated drive means such as in U.S. Pat. No. 3,448,556, mentioned above.

As described above, split stoppers 74 have been developed for insertion into receptacles 31 in freeze drying applications. The slitted portion of the stoppers 74 allows vapors sublimated from the materials undergoing drying within receptacles 31 to escape. When the stoppers 74 are completely inserted into receptacles 31, as discussed below, they effectively seal the receptacles 31 and protect the dried materials in the receptacles 31 from contamination with the ambient air.

Referring now to FIGS. 5 and 2, the stoppering operation of the present invention will be described. The drive rod 49 is rotated when motor 70 is activated, causing cables 47 to wind or unwind from rod 49 along threads 71 and 72. In stoppering, as the cables 47 wind around the rod 49, the lower shelf 39 and the tray 29 in which the receptacles 31 are disposed, begin to move upwardly. Side panels or shields 75 may be mounted to top plate 25 and extend downwardly between the shelves 38 and 39 and cables 47. The side panels 75 act as a guide for lower shelf 39 as it is raised and lowered and also separates the cables 47 from the shelves 38 and 39 to prevent tangling of the cables 47 with the receptacles 31. When the stoppers 74 in the receptacles 31 supported by lower shelf 39 make contact with the bottom of upper shelf 38, the upper shelf 38 is lifted by lower shelf 39 and travels upwardly toward top plate 25 in tandem with lower shelf 39 (see FIG. 5). No stoppering usually occurs at this point since the weight of upper shelf 38 and the receptacles 31 supported thereon is ordinarily insufficient to force the stoppers 74 into the receptacles 31 on the lower shelf 39. The upper shelf 38 travels along guide rods 55 which tend to prevent swaying or other movement of the shelves 38 and 39 as they continue upwardly to top plate 25.

When the stoppers 74 of the receptacles 31 disposed in the tray 29 on upper shelf 38 engage with top plate 25, stoppering commences. Since the plate 25 is fixed to chamber 13, as the shelves 38 and 39 move upwardly the stoppers 74 are forced into the receptacles 31. The shelves 38 and 39 are in effect squeezed together and the receptacles 31 disposed on each are stoppered by the surface immediately above. The receptacles 31 supported on upper shelf 38 are forced against the underside or lower surface 45 of top plate 25. The receptacles 31 supported by lower shelf 39 engage the bottom of upper shelf 38, and as the shelf 39 moves upwardly, stoppering occurs. Once stoppering is completed, the direction of rotation of shaft 49 is reversed, unwinding cables 47 and returning shelves 38 and 39 to their original positions where the stoppered receptacles 31 may be removed.

The operation of stoppering apparatus 23 is simply executed through the flip of a switch, and may be interrupted at any time during the stoppering operation as desired. The direction of rotation of the motor shaft 69 is selected by such switch, and on reversal, the shelves 38 and 39 return to their original positions under force of gravity as the cables unwind from the shaft 49.

As is evident, an improved mechanical stoppering apparatus is shown which eliminates the problems encountered with use of prior art designs. The shelves 38 and 39, trays 29 and top plate 25 are all constructed of strong, durable stainless steel for extended use. Rubber bellows and complicated mechanical structure are eliminated and replaced by a relatively simple apparatus constructed of materials which can withstand the extreme temperature and pressure conditions within chamber 13 without the need for frequent repairs or replacement. The risk of possible contamination of samples associated with the use of bellows is eliminated, and an even rate of sublimation along the entire surface of the shelves is provided since the shelves are substantially insulated from contact with the refrigerated chamber walls.

While two shelves have been shown, it is contemplated that additional shelves could be included, which shelves would be suspended and supported in the same manner as the shelf 38.

Upon a consideration of the foregoing, it will become obvious to those skilled in the art that various modifications may be made without departing from the invention embodied herein. Therefore, only such limitations should be imposed as are indicated by the spirit and scope of the appended claims.

I claim:

1. A stoppering apparatus for use with a freeze dryer, said freeze dryer including a chamber for enclosing receptacles containing material to be freeze dried, said stoppering apparatus comprising:

a fixed plate mounted in an upper portion of said chamber;

an upper shelf adapted to support a plurality of said receptacles to be stoppered, said upper shelf being suspended beneath said fixed plate;

a lower shelf adapted to support a plurality of said receptacles to be stoppered, said lower shelf being suspended beneath said upper shelf;

cables having one end engaged with said lower shelf, the opposite end of said cables being fixed to a rotatable drive shaft; and, means to rotate said drive shaft to elevate said lower shelf causing said receptacles supported on said lower shelf to contact the bottom of said upper shelf, said upper shelf being elevated by said lower shelf in tandem therewith to bring the receptacles on said upper shelf into engagement with said plate, whereby said receptacles on said upper shelf are stoppered against said plate, and said receptacles on said lower shelf are stoppered against the bottom of said upper shelf, said means to rotate said shaft being reversible for lowering said shelves to the original position after stoppering for removal of said receptacles from said chamber of said freeze dryer.

2. The apparatus of claim 1 wherein said fixed plate is provided with front and rear flanges, said plate being horizontally mounted in said chamber by at least four bolts, said front and rear flange sections of said plate being formed with taps correspondingly threaded with said bolts at each end, said chamber being formed with holes in alignment with said taps in said flange sections, said holes corresponding to the diameter of said bolts, whereby said bolts are inserted through said holes in said chamber and threaded into said taps for fixedly mounting said plate to said chamber.

3. The apparatus of claim 2 wherein the orientation of said plate within said chamber is adjustable by rotating said bolts for maintaining said plate in a horizontal position within said chamber.

4. The apparatus of claim 2 wherein said bolts are mounted to said chamber by mounting means comprising;

an insulating button mounted exteriorly of said chamber, said button being formed with first and second bores corresponding to the head and stem sections of said bolts, said first bore having a threaded section; and a cap correspondingly threaded with said first bore, whereby said bolts are inserted into said first and second bores of said button and held thereto by said cap threaded into said first bore to contact the head of said bolts for fixedly attaching said bolts to said chamber while avoiding direct contact of said bolts with said chamber for minimizing transfer of thermal energy therebetween.

5. The apparatus of claim 4 wherein said cap is sealed to said insulating button by an O-ring to prevent loss of vacuum within said chamber.

6. The apparatus of claim 1 having side panels mounted to said plate and extending downwardly to said lower shelf, wherein said upper shelf is adjustably suspended beneath said plate by mounting means comprising:

guide blocks mounted to each corner of said upper shelf, said guide blocks having a flange portion extending outwardly therefrom, said flange portions being formed with a central bore; and, guide rods mounted adjacent the corners of said plate to said side panels in alignment with said bores formed in said flanges, said rods extending downwardly through said bores, said upper shelf being supported on said rods by a collar formed with a first bore corresponding to the diameter of said rods, said collar having a threaded second bore perpendicular to said first bore for receiving a set screw, said set screw being threaded into said second bore to engage and clamp said collar to said rods at various points along said rods beneath said flanges for raising and lowering said upper shelf along said rods to accommodate receptacles of different heights placeable on said upper shelf.

7. The apparatus of claim 1 wherein said lower shelf is adjustably suspended beneath said upper shelf by mounting means comprising:

guide blocks mounted to the corners of said lower shelf, said guide blocks being formed with a central bore; and cables extending downwardly from said plate through said bores in said guide blocks, said lower shelf being supported on said cables by a collar formed with a first bore corresponding to the diameter of said cables, said collar having a threaded second bore perpendicular to said first bore for receiving a set screw, said set screw being threaded into said second bore to engage and clamp said collar to said cables at various points along said cables beneath said guide blocks for raising and lowering said upper shelf along said cables to accommodate receptacles of different heights placeable on said lower shelf.

8. The apparatus of claim 1 having a flange portion mounted to said plate, wherein said drive shaft is rotatably mounted to said flange portion of said fixed plate at one end, the other end of said drive shaft extending outwardly from said chamber for direct coupling with the output shaft of a motor, said shaft being sealed to said chamber by an O-ring to prevent loss of vacuum within said chamber, whereby said drive shaft is rotated by said motor for raising and lowering said shelves.

9. The apparatus of claim 1 including a flange portion mounted to said fixed plate and having first and second pulleys mounted adjacent the corners of said plate, said first pulleys being mounted to the flange portion of said plate, said second pulleys being mounted to the edge of said plate, wherein said cables fixed to said rotatable drive shaft at one end extend through said first and second pulleys from said drive shaft downwardly to engage with said lower shelf, said drive shaft being formed with right and left threads, whereby as said drive shaft rotates in one direction said cables are wrapped around said drive shaft along said threads for raising said shelves, and as said drive shaft rotates in the reverse direction said cables are unwrapped from said drive shaft for lowering said shelves.

10. A stoppering apparatus for use with a freeze dryer, said freeze dryer including a chamber for enclosing receptacles containing material to be freeze dried, said stoppering apparatus comprising:

a fixed plate mounted in an upper portion of said chamber;

a bottom shelf adapted to support a plurality of said receptacles to be stoppered, said bottom shelf being suspended beneath said fixed plate;

at least one intermediate shelf adapted to support a plurality of said receptacles to be stoppered, said intermediate shelf being suspended between said fixed plate and said bottom shelf;

cables having one end engaged with said bottom shelf, the opposite end of said cables being fixed to a rotatable drive shaft; and, means to rotate said drive shaft to elevate said bottom shelf causing said receptacles supported on said bottom shelf to contact the bottom of said intermediate shelf, said intermediate shelf being elevated in tandem with said bottom shelf to bring the receptacles on said intermediate shelf into engagement with the bottom of said fixed plate, whereby said receptacles on said intermediate shelf are stoppered against said plate, and said receptacles on said bottom shelf are stoppered against the bottom of said intermediate shelf, said means to rotate said shaft being reversible for lowering said shelves to the original position after stoppering for removal of said receptacles from said chamber of said freeze dryer.

* * * * *